US008496067B2

(12) United States Patent
Koelewijn et al.

(10) Patent No.: US 8,496,067 B2
(45) Date of Patent: Jul. 30, 2013

(54) DEVICE AND METHOD FOR PROTECTING AN OBJECT AGAINST FIRE

(76) Inventors: Fernandus Cornelis Koelewijn, Ridderkerk (NL); Pieter Plaizier, Ridderkerk (NL)

( * ) Notice: Subject to any disclaimer, the term of this patent is extended or adjusted under 35 U.S.C. 154(b) by 1003 days.

(21) Appl. No.: 11/596,886

(22) PCT Filed: May 13, 2005

(86) PCT No.: PCT/NL2005/000367

§ 371 (c)(1),
(2), (4) Date: Sep. 10, 2007

(87) PCT Pub. No.: WO2005/110548

PCT Pub. Date: Nov. 24, 2005

(65) Prior Publication Data

US 2008/0190627 A1 Aug. 14, 2008

(30) Foreign Application Priority Data

May 18, 2004 (NL) ..... 1026216

(51) Int. Cl.

| | |
|---|---|
| ***A62C 2/00*** | (2006.01) |
| ***A62C 31/22*** | (2006.01) |
| ***A62C 25/00*** | (2006.01) |
| ***A62C 37/10*** | (2006.01) |
| ***A62C 35/58*** | (2006.01) |
| ***A62C 37/36*** | (2006.01) |

(52) U.S. Cl.
USPC ..... 169/46; 169/70; 169/51; 169/61; 169/27; 169/81; 169/19; 169/47; 169/29

(58) Field of Classification Search
USPC ..... 169/46, 30, 51, 56, 48, 61, 60, 27, 169/81, 5, 54, 62, 13, 14, 24, 70, 64, 52, 169/19, 45, 47, 26, 29; 239/135, 337, 5; 222/394
See application file for complete search history.

(56) References Cited

U.S. PATENT DOCUMENTS 1,757,213 A * 5/1930 Partlow ..... 169/27
3,897,828 A * 8/1975 Glover ..... 169/43

(Continued)

FOREIGN PATENT DOCUMENTS

DE 100 17 670 A 12/2001
FR 2 843 886 A 3/2004

(Continued)

*Primary Examiner* — Dinh Q Nguyen
*Assistant Examiner* — Steven M Cernoch
(74) *Attorney, Agent, or Firm* — Harness, Dickey & Pierce, P.L.C.

(57) ABSTRACT

Example embodiments provide a device for protecting an inner space of an object against fire, including a housing provided with at least one passage opening; an aerosol-forming extinguishing element arranged in the housing and which may include a container for holding extinguishing material which can be activated at a fixed activating temperature; at least one outlet opening which can be connected to the passage opening in the housing and along which the activated extinguishing material can be carried into the inner space of the object so as to extinguish the fire; an activating element for bringing at least part of the extinguishing material to the activation temperature; at least one detection unit arranged in or close to the housing for detecting at least one physical and/or chemical parameter representative of fire in the inner space; and a control unit arranged in the housing for causing thermal activation of the extinguishing element by the activating element when a preset activation value of the detected physical and/or chemical parameter is reached. The housing may be embodied for placing in the inner space of the object.

27 Claims, 5 Drawing Sheets

U.S. PATENT DOCUMENTS

| | | | | | |
|---|---|---|---|---|---|
| 4,250,967 | A * | 2/1981 | Horwinski et al. | 169/49 |
| 4,718,498 | A * | 1/1988 | Davios et al. | 169/62 |
| 4,815,694 | A * | 3/1989 | Ferren et al. | 251/25 |
| 5,207,276 | A * | 5/1993 | Scofield | 169/61 |
| 5,355,026 | A * | 10/1994 | Scofield | 307/117 |
| 5,361,847 | A * | 11/1994 | Phelps | 169/58 |
| 5,613,564 | A * | 3/1997 | Rhines | 169/61 |
| 5,617,923 | A * | 4/1997 | Nishikubo et al. | 169/51 |
| 5,936,531 | A * | 8/1999 | Powers | 340/628 |
| 5,959,524 | A * | 9/1999 | Wienand et al. | 338/28 |
| 6,003,609 | A * | 12/1999 | Walls | 169/57 |
| 6,104,301 | A * | 8/2000 | Golden | 340/628 |
| 6,189,624 | B1 * | 2/2001 | James | 169/61 |
| 6,244,353 | B1 * | 6/2001 | Greer | 169/61 |
| 6,360,825 | B1 * | 3/2002 | Padgett et al. | 169/65 |
| 6,834,728 | B2 * | 12/2004 | Demole | 169/5 |
| 6,836,217 | B2 * | 12/2004 | Andreas | 340/605 |
| 7,100,701 | B2 * | 9/2006 | Sprakel et al. | 169/60 |
| 7,117,950 | B2 * | 10/2006 | McLane, Jr. | 169/9 |
| 2003/0062175 | A1 * | 4/2003 | Olander et al. | 169/51 |
| 2003/0094287 | A1 * | 5/2003 | Demole | 169/24 |

FOREIGN PATENT DOCUMENTS

| | | | |
|---|---|---|---|
| FR | 2843886 | A1 * | 3/2004 |
| WO | WO 93/15793 | A | 8/1993 |
| WO | WO 9315793 | A1 * | 8/1993 |
| WO | WO 02055154 | A1 * | 7/2002 |
| WO | WO 03/024534 | A | 3/2003 |

* cited by examiner

DEVICE AND METHOD FOR PROTECTING AN OBJECT AGAINST FIRE

Example embodiments relate to a device and method for protecting an object against fire.

BACKGROUND

Many types of fire extinguishers are known for protecting buildings or accommodation areas in general. Some of these are connected to the water mains or to a voluminous water storage tank and extinguish a fire by means of water. This manner of extinguishing a fire is unsuitable in spaces in which is located equipment which can be damaged by water. When electrical components are for instance located in the space, the water can cause short-circuiting. Even if the water is able to extinguish the fire, the components will in many cases have become useless due to the water. The known extinguishers moreover have quite a large size, which makes them unsuitable for use in protecting relatively small objects.

For the protection of inner spaces of smaller objects such as machines or hardware against fire, fire extinguishers are further known in which a pressure cylinder, which is provided with an extinguishing agent (gas, liquid or solid) is stored under overpressure. In the case of fire the pressure cylinder is opened and the extinguishing agent is guided outward as a result of the overpressure. A drawback of the known fire extinguishers is that the extinguishing agent present therein often has an adverse effect on the inner space in question. The known extinguishing agents are moreover harmful in greater or lesser degree to the environment and to humans. Finally, the known fire extinguishers are unsuitable for placing inside objects.

In addition, aerosol-forming fire extinguishers are known in which, after activation of the fire extinguisher, the extinguishing agent is converted into an aerosol which is carried into the inner space. An example of such an aerosol-forming fire extinguisher is the fire extinguisher known under the brand name "FirePro®". After thermal (including electrical) activation, the extinguishing agent stored in a container in the fire extinguisher is converted into an aerosol which does not combat fire so much by making use of conventional methods based only on smothering or based only on cooling, but by ending the combustion reaction on a molecular basis. The free radicals present in the fire are herein bonded by the generated aerosol without affecting the local oxygen content. These extinguishing elements have the advantage that a fire is extinguished quickly and efficiently without this resulting in appreciable damage to the environment, people or to the object itself. After the cause of the fire has been removed and the aerosol optionally blown out of the closed space, the object can in many cases be used again immediately without delay, even if sensitive equipment such as electronic components is placed in the inner space. The inner space in general and the electronic components in particular in any case remain unaffected by the aerosol.

The known aerosol-forming fire extinguishers are activated when the temperature of the extinguishing material in the container reaches a determined minimum value. When a fire therefore breaks out, the temperature of the extinguishing material will increase due to heat penetrating into the container. When said minimum temperature is reached, the extinguisher is activated by transformation of the extinguishing material into expanding extinguishing aerosol. A drawback of the known aerosol-forming fire extinguisher is that the activating temperature is quite high (typically in the order of magnitude of +/−330 °C.) so that the fire extinguisher is switched on relatively late and the damage resulting from the fire can thereby be considerable. The activating temperature for a specific fire extinguisher furthermore has a fixed value.

In order to obviate this drawback it is known to provide the aerosol-forming fire extinguisher with a thermally conductive cord which extends partly outside and partly inside the container of the fire extinguisher. The thermo-cord is placed in the vicinity of possible sources of fire. As soon as there is fire, and therefore generation of heat, heat is conducted via the cord into the container of the fire extinguisher. This means in practice that the fire extinguisher can already be activated at lower ambient temperatures (such as at about 172° C.). The activating temperature however remains determined mainly by the composition of the extinguishing material, and therefore has a (practically) fixed value for a specific fire extinguisher. However, since the fire extinguisher must already be switched on in the one object at an earlier stage, for instance at a lower temperature, than in another object, the known fire extinguisher is less suitable for universal application.

From the American document WO 03/024534 A1 a system is known for suppressing fire in the freight compartment of a passenger aircraft. Outside the compartment for protecting there are placed a number of housings provided with aerosol fire-extinguishing units. The extinguishing elements can blow the aerosol into the compartment via openings in the ceiling of the compartment. A number of separate smoke detectors are also arranged in the ceiling. The extinguishing units and smoke detectors are connected to a data network and a central control unit (cargo fire detection control unit). The activation of the extinguishing elements is therefore effected centrally by means of an external control unit. The known system is thereby complicated and costly, and moreover sizeable, so that it is less suitable for arranging in the small inner space of an object such as a switch cabinet, a computer or the like. The known system is also unsuitable for arranging in the inner space of the object for protecting against fire because the control unit and the wire network are arranged outside the housing and are thereby sensitive to fire.

SUMMARY

Example embodiments provide a device and method for protecting objects against fire, in which at least this latter drawback is obviated.

According to a first aspect of example embodiments, there is provided for this purpose a device for protecting an inner space of an object against fire, which device comprises:

- a housing provided with at least one passage opening;
- an aerosol-forming extinguishing element which can be arranged in the housing and which comprises:
  - a container for holding extinguishing material which can be activated at a fixed activating temperature;
  - at least one outlet opening which can be connected to the passage opening in the housing and along which the activated extinguishing material can be carried into the inner space of the object so as to extinguish the fire;
- an activating element for bringing at least part of the extinguishing material to the activation temperature;
- at least one detection unit arranged in or close to the housing for detecting at least one physical and/or chemical parameter representative of fire in the inner space;
- a control unit arranged in the housing for causing thermal or electrical activation of the extinguishing element by the activating element when a preset activation value of the detected physical and/or chemical parameter is reached, wherein the housing is embodied for placing in the inner space of the object.

In a first preferred embodiment, the detection unit is a detector for measuring the parameter, and the control unit comprises an electrical control for controlling the thermal activation of the extinguishing element.

By making use of one or more detectors to measure one or more physical parameters as well as a control which switches the extinguishing element on when the one or more physical parameters indicate outbreak of fire, the activation value can be preset quickly and accurately. This greater accuracy enables an improved fire prevention. The adjustability ensures that the same (type of) extinguishing element is suitable for different situations in different objects, which greatly increases the applicability of the device. Because not only the extinguishing element but also the control thereof are moreover arranged inside the housing, an autonomously operating protection device is provided which can be given a compact form so that it can be placed in simple manner inside the objects representing a potential fire hazard.

In view of the above stated advantages, an aerosol-forming extinguishing element is applied. More specifically, the extinguishing element then comprises a container for holding extinguishing material which is transformed into an expanding, dry extinguishing aerosol after activation. According to a particularly advantageous embodiment, the extinguishing element comprises a cooling section for cooling the expanding extinguishing aerosol before it exits the passage opening. The chance of damage to the environment is hereby further reduced.

In a preferred embodiment, the detector comprises a temperature sensor and the physical parameter is the temperature of the medium in the inner space of the object. When the physical parameter is the temperature of the environment of the sensor, i.e. the temperature in the inner space of the object, this ambient temperature at which the extinguishing element of the device will begin to extinguish can thus be preset as desired. It is noted that the activation value according to the invention can be precisely set such that the extinguishing element is already switched on when a fire first starts instead of when a fire is at an advanced stage. This means that the chance of fire damage is minimal.

According to another preferred embodiment, the detector comprises a smoke detector, such as for instance a CO-detector, and the parameter is the concentration of one or more smoke gases in the inner space. When the physical parameter is the concentration of smoke gases, accurate presetting is then possible of the concentration of smoke gases at which the extinguishing element is set into operation. In this embodiment the extinguishing element can also be switched on quickly, for instance when the concentration of smoke gases increases rapidly due to smoldering while the temperature of the inner space has not yet increased, or at least not sufficiently so. In other embodiments the device is provided with one or more temperature sensors as well as one or more smoke sensors, or a combined temperature-smoke detector is provided.

In other preferred embodiments the detector is a flame sensor which is sensitive to radiation emitted by the flames. The flame sensor can herein be an infrared sensor which is sensitive to radiation in the infrared spectrum emitted by the flames or an ultraviolet flame sensor which is sensitive to radiation in the ultraviolet spectrum emitted by the flames of the fire.

In a further preferred embodiment, the detector comprises glass fibre cabling which is adapted to detect a temperature change.

In a further preferred embodiment, the activating element comprises a thermally conductive body, in particular a thermally conductive cord, and a heat source to be controlled by the control for heating the thermally conductive body. In this embodiment use can be made of the above stated, already available fire extinguishers which are provided with a thermally conductive cord for activating the extinguishing material. In an advantageous embodiment the heat source comprises an electrical power supply, in particular consisting of one or more batteries, in combination with an electrical resistance. The resistance herein ensures the desired generation of heat.

According to another preferred embodiment, the activating element comprises an electrical ignition to be controlled with the control.

According to a preferred embodiment, the control comprises a programmable electronic circuit, for instance a microcontroller, in which the activation value of the physical quantity can be stored. In this embodiment both the manner of control and the activation value can be set quickly and easily in terms of software, for instance by pre-programming the microcontroller with an external computer.

According to a further preferred embodiment, several extinguishing elements are arranged in the housing. This enables an increase in the extinguishing capacity or repeated successive extinguishing, which enhances the possibilities and the safety of the device with a view to the risk of the fire restarting once the extinguishing material, in particular the aerosol, is exhausted. It is of course also possible to couple several devices to each other in order to realize an increase in the extinguishing capacity.

According to a preferred embodiment, the device comprises fixing means for fixing the housing to the object for protecting. The fixing means preferably comprise at least one support which can be fixed to the housing as well as double-sided tape for fixing the at least one support to the object. This construction ensures a simple and rapid mounting of the device in the inner space. Fixing with other means, such as screws, is of course also possible.

In a further preferred embodiment, the device comprises communication means for transmitting status messages representative of the status of the device. The status of the device can for instance relate to whether or not the extinguishing element is activated, the time of activation, the exact position of the activated extinguishing element, the capacity of the battery (for instance almost or completely empty), whether one or more components of the device are malfunctioning or not, and so on. In particular, a status message can report the activation of the extinguishing element so that the receiver of the message can take action immediately. The communication means preferably comprise a transmitter for wireless transmission of messages, in particular SMS or e-mail messages and wire communication.

In a further preferred embodiment, the communication means are further adapted to receive instruction messages on the basis of which the control can control the operation of the device. An example hereof is when the control is coupled to an external power supply, so that the control can switch this on or off. When detecting fire the control can for instance receive the instruction to switch off the power supply to electrical components present in the inner space, such as a fan in a computer. It is noted that power supply is also understood to mean the domestic mains supply. In that case the power supplied by the mains is switched off, for instance by operating the main switch in a meter cupboard of a building.

The device is also preferably autonomous, which means that it can function entirely on its own. An external power supply, external extinguishing material or compressed air are for instance unnecessary.

According to a further preferred embodiment, the device comprises signalling means for signalling the activation of the extinguishing element, for instance by generating an optical and/or acoustic signal. In a particularly advantageous embodiment, the signalling means are adapted to generate a pre-alarm as a precursor of the activation of the extinguishing element. This means that someone can take action before the fire breaks out.

In another preferred embodiment, a device is provided wherein the control unit comprises a reaction vessel with at least two reaction spaces separated by a detection unit in the form of a separating element, wherein the separating element is embodied for melting at a preset activation temperature, wherein different chemical substances are arranged in the spaces, which react with each other when the separating element melts in order to activate at least part of the extinguishing material with the released heat of reaction via the thermally conductive element.

In this embodiment the activation value of the extinguishing element can also be precisely set. An additional advantage is moreover that the device does not require a power supply and thereby has an almost unlimited lifespan.

According to a further aspect of the invention, an assembly is provided for protecting at least one inner space of an object against fire, which system comprises a number of the above stated devices and wherein transmitters are provided in each of the devices for the purpose of transmitting status messages representative of the status of the device. The system further comprises a central transmitter/receiver for receiving the status messages from the devices and transmitting the status messages to an external control room or controller.

According to a further aspect of the present invention, there is provided a method for protecting an inner space of an object against fire, comprising of:

placing one or more of the devices according to the invention stated herein in the inner space; and setting the activation value at which the one or more extinguishing elements are to be activated.

Further advantages, features and details of the present invention will be elucidated on the basis of the description of some preferred embodiments thereof. Reference is made in the description to the accompanying figures, in which:

BRIEF DESCRIPTION OF THE DRAWINGS

FIGS. 5A and 5B show a schematic representation of another preferred embodiment, wherein FIG. 5A shows the situation before activation and FIG. 5B the situation after activation;

DETAILED DESCRIPTION OF EXAMPLE EMBODIMENTS

Figure 1:
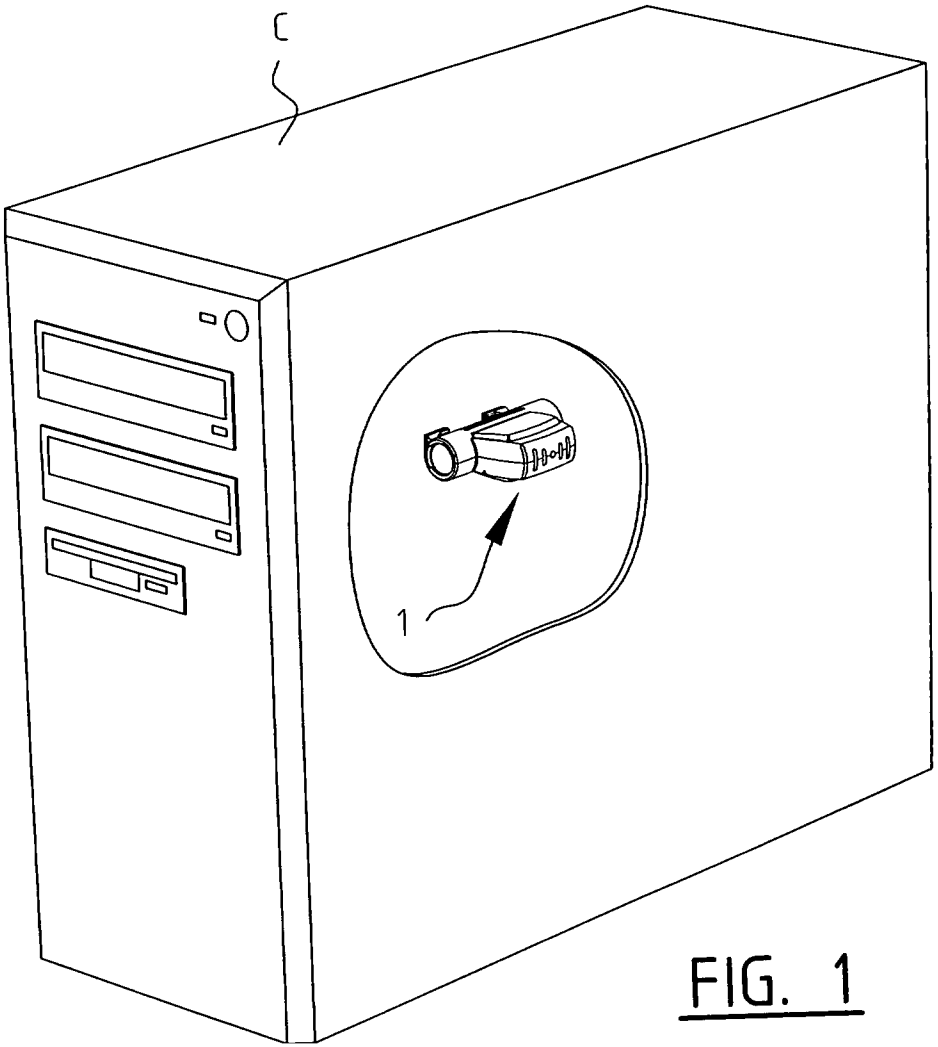
FIG. 1 shows a partly cut-away perspective view of an object in the form of a personal computer, which is provided with a first preferred embodiment of the invention.

FIG. 1 shows a personal computer C which is protected from fire damage by means of a first preferred embodiment of the fire-extinguishing system 1 according to the invention. Fire-extinguishing system 1 is arranged inside a closed inner space of the computer, for instance by fixing the system to one of the (inner) walls of the computer housing. It is noted that the inner space is not necessarily a closed space. The general term "inner space" should also be understood to mean any space in communication with the environment, such as the outside air. When an appliance is for instance partly enclosed by a casing or housing, for instance by an insulating housing of a fan or a casing of a heating element, this is also an inner space in the sense of the present invention.

The system is intended for detecting fire (which includes any start of a fire, scorching, smoldering etc.) in the electronic components in the closed space of the computer, which fire for instance is the result of short-circuiting, and if necessary extinguish this fire by filling the space with a sufficient quantity of extinguishing material.

The fire-extinguishing system 1 is constructed from a housing 2 consisting of an upper housing part 2*a* and a lower housing part 2*b* which are fixed to each other by means of screws 9 in the position of use. Housing 2*a*, 2*b* is preferably manufactured from heat-resistant plastic in an injection moulding process, so that a housing with a relatively light weight can be provided. It is however also possible to envisage other embodiments and material types of the housing. The housing is embodied (choice of material, shape, position and dimensions of the openings etc.) such that a sufficient protection from fire of the contents of the housing is ensured.

Gaps 10 are provided in housing 2*a*, 2*b* so that the medium in the inner space of the object (in most cases air, but a different medium is also a possibility) can penetrate into the housing and practically the same temperature therefore prevails inside the housing as outside it. Slots 39 in housing part 2*a* are specifically intended for cooling of extinguishing element 3, to be discussed further, once this element has been activated. Supports (e.g., two fixing feet) 12 can further be arranged in housing 2*a*, 2*b* by means of pins 13, in which the supports 12 can be attached to a surface, for instance, on the inner side of the computer housing or an inner wall of the computer, using double-sided tape 11. The components described below in detail are further provided, among others, in housing 2*a*, 2*b*.

Figure 2:
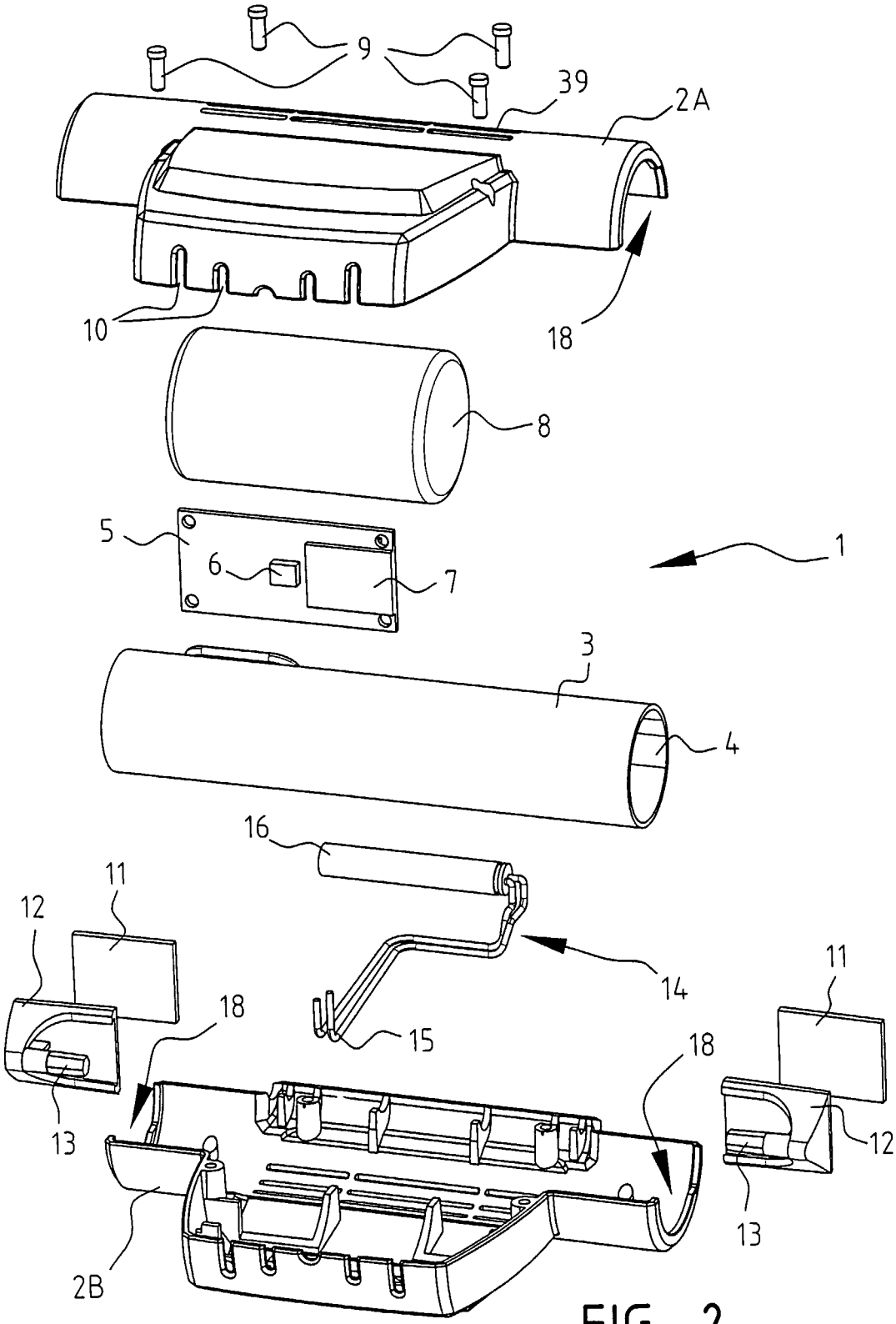
FIG. 2 is an exploded view in perspective of the preferred embodiment of FIG. 1.

A cylindrically embodied, autonomously operating extinguishing element 3 is provided in longitudinal direction. In the particularly advantageous embodiment shown, extinguishing element 3 is of a type which makes use of a dry aerosol to combat and extinguish the fire. For this purpose a dry extinguishing material is provided in fire-extinguishing element 3 which, after activation, is expelled as a dry aerosol via two openings 4 (of which only the right-hand opening is shown in FIG. 2). Aerosol herein designates a colloidal mixture of dust and gas, i.e. the dust is finely distributed in the gas, wherein the dust particles are larger than a molecule and smaller than in a so-called suspension. In an advantageous embodiment the dry aerosol consists of finely distributed particles (about 40% of the mass), specifically based on alkali metal salts and gases (about 60% of the mass) consisting mainly of nitrogen, carbon dioxide and water vapour. The dry aerosol extinguishes chemically, by intervening in the chain reaction of the flames by bonding the free radicals, as well as physically, by cooling the source of the fire. Both actions take place mainly on the surface of the particles in the dry aerosol of micro-size. These particles are suspended in an inert gas, wherein the ratio between the exposed surface area and the reaction mass is extremely high, whereby the quantity of active material required for the extinguishing can be limited to a minimum. The stated particles remain in suspension for a relatively long time, whereby they can flow into the natural convection currents present during combustion. This results in an increased efficiency of the extinguishing material. For a further description of the preferably applied extinguishing elements reference is made to EP 0 925 808 B1, the content of which must be deemed as interpolated herein.

More specifically, a fire-extinguishing element highly suitable for extinguishing the fire is for instance an aerosol-forming fire extinguisher known under the brand name "FirePro®". The FirePro® aerosol-forming fire-extinguishing element comprises a non-pressurized reactor in which solid extinguishing material is arranged. After thermal (including electrical) activation the extinguishing material is converted into an aerosol. The aerosol generated by the FirePro® fire-extinguishing element does not combat fire so much by making use of conventional methods based only on smothering (depriving of oxygen) or based only on cooling, as already set forth above, but by ending the combustion reaction on a molecular basis. The free radicals present in the fire are herein bonded by the generated aerosol without affecting the local oxygen content. These extinguishing elements have the advantage that a fire is extinguished quickly and efficiently without this resulting in appreciable damage to the environment, people or to the object itself. Once the cause of the fire has been removed and the aerosol optionally blown out of the closed space, the object can in many cases be used again immediately without delay, even if sensitive equipment such as electronic components is placed in the inner space. The inner space in general and the electronic components in particular in any case remain unaffected by the aerosol.

In a position of use both passage openings 4 of fire-extinguishing element 3 can be provided at the position of openings 18 in housing 2*a*, 2*b*. Upon activation of the fire-extinguishing element the dry aerosol can therefore be emitted at both ends of the housing and thereby fill the inner space inside computer C with dry aerosol.

The passage openings can otherwise be closed with a thin membrane in order to keep moisture and dirt outside the housing. Upon activation of the fire-extinguishing element the extinguishing material can still flow outside via the passage openings, for instance when the membrane is embodied such that it will melt as a result of the higher temperature of the outflowing aerosol.

The operation of fire-extinguishing element 3 is such that activation of the fire-extinguishing element 3 normally occurs when the temperature of the extinguishing material inside the fire-extinguishing element becomes too high as a result of a relatively high temperature outside the fire-extinguishing element, i.e. the temperature in the housing (which is substantially equal to the temperature of the inner space when the housing takes a heat-conducting form or when gaps 10 are provided in the housing) or the temperature outside the housing and inside the inner space (when a sensor is arranged outside the housing of the system). The temperature in extinguishing element 3 at which the extinguishing material is activated is referred to here as the activating temperature. The above described aerosol-forming fire extinguishers have an activating temperature of around 250° C. and higher, usually a temperature of about 300° C. The outside temperature in the inner space, at which the extinguishing element is activated by penetration of heat from the outside, generally differs considerably and depends among other things on the type applied and the specific embodiment of the fire-extinguishing element, the speed at which the fire develops, etc.

In most cases this relatively high outside temperature does however mean that the fire has already caused much damage to the object for protecting. In order to already activate fire-extinguishing element 3 at a low temperature the fire-extinguishing elements can be provided in known manner with different types of ignition mechanisms. In order to activate fire-extinguishing element 3 at said lower temperatures, use is for instance made of an electro-thermal igniting element or a thermally conductive element, in particular a thermally conductive wire or cord (referred to below as thermo-cord). The thermo-cord is partly in the extinguishing element and extends as far as the extinguishing material, and protrudes partly outside the extinguishing element. In the embodiment shown in FIG. 4 a thermo-cord is a heat-conducting cable manufactured from a chemical composition which is activated as soon as the temperature has risen to a preset level or when the cable is exposed directly to fire. When the thermo-cord is for instance a wire manufactured from natural rubber, the wire functions as a fuse. When an end thereof is exposed to a sufficiently high temperature, it is ignited and heat is transferred from the ignited end to the opposite outer end.

In the known extinguishing systems heat is developed in the initial stage of the fire, which heat is conducted directly into the interior via the thermally conductive wire. This results in activation of the extinguishing element at temperatures lower than the above mentioned temperature values. The thermo-cord after all ensures that heat reaches the interior of fire-extinguishing element 3 more quickly than would be the case if no thermo-cord is applied and heat enters from the outer wall or from the fire-extinguishing element. Also in this known embodiment the outside temperature at which the extinguishing element is activated still depends on a great number of factors, such as for instance the type and specific embodiment of the extinguishing element.

Figure 3:
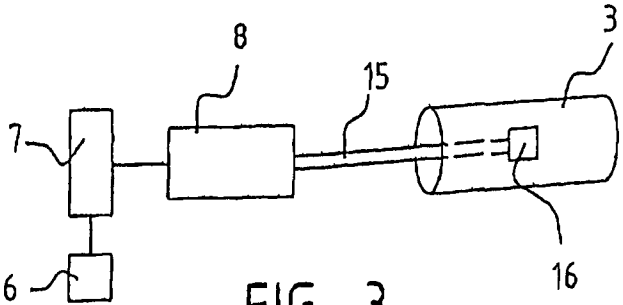
FIG. 3 is a schematic representation in which the operation of the first preferred embodiment shown in FIGS. 1 and 2 is further elucidated.

The preferred embodiment of FIGS. 2 and 3 shows a greatly improved activating mechanism. An igniter 14 is arranged in the fire-extinguishing element 3 instead of a thermo-cord, which igniter consists of a metal cylindrical element 16 (shown) or a filament (not shown) and two electric wires 15 connected thereto. Wires 15 are connected to a power supply such as an optionally rechargeable accumulator or battery 8. By conducting power of sufficient amperage through the circuit formed by wires 15, resistance element 16 and battery 8, the resistance element 16 is heated as a result of resistance that occurs. This heating provides for a sufficient increase in the temperature of the extinguishing material to bring about activation of extinguishing element 3.

In order to control opening and closing of the circuit, the electric wires 15 are connected to a PCB (printed circuit board) 5 on which is provided a number of electronic components. PCB 5 for instance comprises a programmable microcontroller 7 and a temperature sensor 6. Temperature sensor 6 measures the temperature of the ambient air continuously or intermittently and generates an electric signal representative of the measured temperature to microcontroller 7. The accuracy with which the temperature is determined depends on the type and quality of the temperature sensor. A measurement accuracy of several degrees Celsius (preferably less than 10° C., more preferably less than 1° C.) is acceptable in practice. In determined embodiments the temperature sensor can comprise a bimetal element so that the measuring of the temperature can be carried out entirely or almost entirely without using energy. Microcontroller 7 receives the electric signal and on the basis thereof compares the ambient temperature to an activation value preset by the user.

Although temperature sensor 6 is provided in the shown embodiment on PCB 5, it will be apparent that the sensor can also be provided at other positions. The sensor can for instance also be positioned inside housing 2*a*, 2*b* in the vicinity of gaps 10 or outside the housing. When the sensor is placed outside housing 2*a*, 2*b*, it can be placed in the vicinity of the most readily flammable components in the inner space. A contact sensor can also be arranged on one or more components, not so much to measure the temperature of the ambient air but to directly measure the temperature of the relevant component.

The activation value can be set as desired by the user by correct programming of microcontroller 7. For this purpose microcontroller 7 is provided with an input/output port (not shown) whereby communication with an external appliance, for instance a laptop, is possible. Via the laptop the activation value of the temperature can thus be set subject to the properties of the extinguishing element and of the object for protecting. Instead or in addition, the programmable electronic circuit 7 can be programmed by adjusting an adjustable circuit such as a potentiometer.

When the measured outside temperature has reached the activation temperature, the programmable electronic circuit, here in the form of a microcontroller 7, ensures closing of said circuit. As stated above, this results in element 16 generating heat, as a result of which the extinguishing element 3 is activated and the generated aerosol is carried into the inner space through openings 4, 18.

Figure 4:
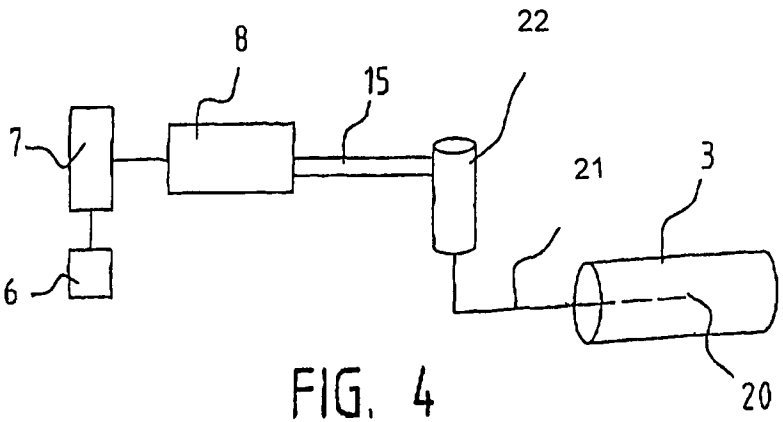
FIG. 4 shows a schematic diagram in which the operation of another preferred embodiment of the invention is set forth.

FIG. 4 shows an alternative preferred embodiment in which a thermally conductive wire or cord 21 is arranged in known manner in fire-extinguishing element 3. Around the thermally conductive cord 21 is provided a metal element 22, which is connected to battery 8 by means of electrical wires 15. In a manner as discussed above in respect of the first preferred embodiment, battery 8 is connected to cord 21 by microcontroller 7 subject to the signal generated by temperature sensor 6. When the outside temperature detected by sensor 6 in the inner space of the object has reached the activation value, microcontroller 7 gives the command to close the circuit formed by battery 8, wiring 15 and element 22. As a result of the resistance occurring in element 22, element 22 will begin to generate heat, which heat will reach the interior 20 of fire-extinguishing element 3 via thermo-cord 21. This activates the extinguishing material present inextinguishing element 3.

An advantage of the embodiment shown in FIG. 4 is that use can be made of a fire-extinguishing element 3 provided as standard with a thermo-cord 21, wherein the ignition can be performed in very simple manner. This embodiment is applied particularly in the relatively small fire-extinguishing elements. Using the thermo-cord the temperature in the inner space at which the extinguishing element is activated can be reduced from about 300° C. to less than 200° C. (often 172° C. practice).

Figure 5A:
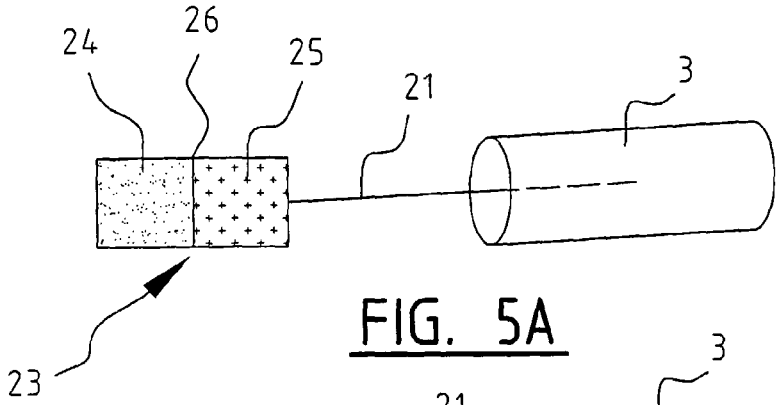
Figure 5B:
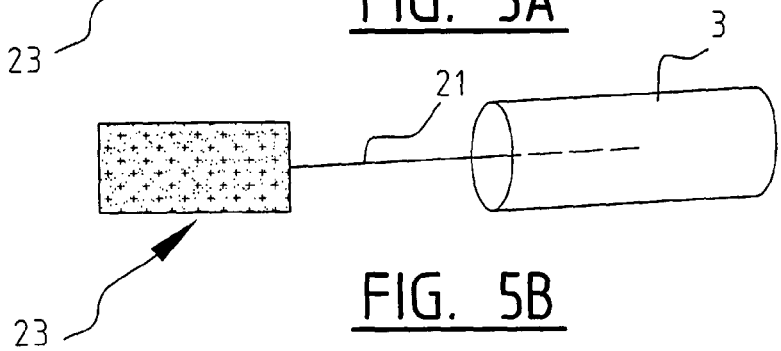

In another preferred embodiment, as for instance shown schematically in FIGS. 5A and 5B, the fire-extinguishing element is once again provided with the known thermally conductive element in the form of thermo-cord 21. The one outer end of thermo-cord 21 extends into the fire-extinguishing element, while the other outer end of thermo-cord 21 extends into a reaction vessel 23. The reaction vessel consists inter alia of a left-hand compartment 24, in which a first chemical composition is arranged, and a right-hand compartment 25 in which a second chemical composition is arranged. Both compartments 24, 25 are mutually separated by a separating wall 26. Separating wall 26 is manufactured from material which melts at a previously known temperature. The material is herein chosen such that separating wall 26 melts at that temperature in the inner space at which the fire-extinguishing element 3 will have to be activated. Once the separating wall has melted, the chemical composition in left-hand compartment 24 comes into contact with the composition in right-hand compartment 25 and enters into a reaction therewith. Thermo-cord 21 is heated as a result of the heat of reaction that occurs. Thermo-cord 21 subsequently transfers its heat to the extinguishing material in extinguishing element 3, which is then activated.

An advantage of this embodiment is that it has an unlimited lifespan. In contrast to the above stated embodiments in which small quantities of energy are lost by keeping on standby and operating the different electronic components, such as the sensor, the microcontroller and so on, there is no loss of energy in the present embodiment as long as the activation temperature has not yet been reached. This makes the embodiment particularly suitable for applications in which the inner space is difficult to access after the extinguishing system has been placed. A further advantage is that in the present embodiment the activating mechanism is completely insensitive to electromagnetic influences from outside, which is important for instance in applications where there are strong electromagnetic fields.

The above described embodiments relate in each case to a fire-extinguishing system which is provided with a single extinguishing element which is moreover arranged at a single position in the object for protecting. It is however also possible to envisage arranging two or more extinguishing elements in a single housing, or to provide the object for protecting with two or more housings provided with extinguishing means so as to ensure a more uniform distribution of the aerosol over the inner space.

When two or more extinguishing elements are applied, the control of the extinguishing elements can be adapted according to another preferred embodiment of the invention to activate only some of the extinguishing elements when a fire starts. The other extinguishing elements can then still be activated in the unlikely case the fire starts again. When use is for instance made of a double extinguishing unit (two extinguishing elements in two housings or two extinguishing elements in a single housing), the first extinguishing element extinguishes the fire while the second extinguishing element is ready, in case the fire restarts within a determined time, for instance within half an hour, to once again extinguish the re-started fire. A simultaneous extinguishing by two or more fire-extinguishing elements optionally coupled to each other is also a possibility, depending on the object for protecting and the required extinguishing material.

Figure 6:
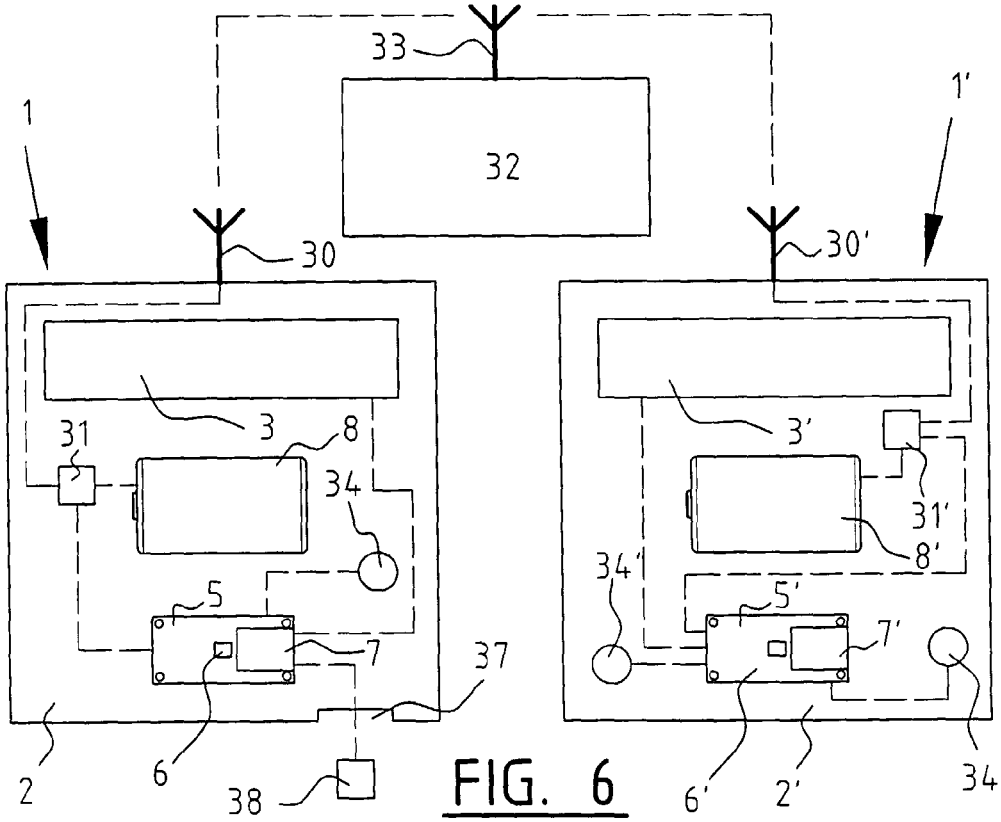
FIG. 6 shows a schematic diagram of a system of a number of the preferred embodiments which are connected to an alarm system.

FIG. 6 shows schematically an embodiment in which two housings 2, 2' are provided in an above described manner with extinguishing means such as a fire-extinguishing element 3,3', a battery 8,8', a PCB 5,5', a temperature sensor 6, 6' and microcontroller 7, 7'. The two extinguishing systems 1, 1' are arranged at different positions inside a determined inner space or in different inner spaces. Communication means 30, 30' are further provided in each of the extinguishing systems 1, 1'. In the shown embodiment there is provided in each housing 2, 2' a transmitter 31, 31' which is connected to antenna 30, 30' deployed inside and/or outside the housing. A centrally disposed transmitter/receiver 32 is also placed in the vicinity of fire-extinguishing systems 1, 1'. Using antenna 33 the transmitter/receiver 32 can receive the signals transmitted via transmitters 31, 31'. When extinguishing element 3 is for instance activated under the control of a microcontroller 7, transmitter 31 is simultaneously instructed by microcontroller 7 to send a signal to transmitter/receiver 32, which signal forms a message representative of the status of the relevant extinguishing system 1. When extinguishing element 3 is activated, transmitter 31 therefore sends a message to transmitter/receiver 32 which reports the activation of the extinguishing element. Via an antenna 33 and/or via a wired network the transmitter/receiver 32 then transmits a report to for instance a control room or directly to for instance the controller of the objects for protecting. The reporting can for instance take place in the form of an SMS message to a mobile phone of the controller and/or via an e-mail message to the e-mail address of the controller. This means that the controller is notified practically in real-time of the activation of one or more of its fire-extinguishing systems 1, 1'. The system itself can even be embodied such that the report received by the controller contains an indication of which of the appliances is beset by a starting fire. The controller can then inspect the appliance in question, try to discover the cause of the starting fire and take steps to prevent the fire restarting.

In a further embodiment, transmitter/receiver 32 is also adapted to receive instructions from the controller, which instructions can be transmitted via the wireless connection between transmitter/receiver 32 and fire-extinguishing systems 1, 1'. An instruction can for instance mean that when a determined extinguishing element 3, 3' becomes active, the supply voltage to the appliance in question or the supply voltage to a part of the appliance, such as a fan, must be switched off. When a microcontroller 7 is for instance connected to output port 37, which is connected to a switch 38 with which the supply voltage to the relevant appliance can be switched on and off, the microcontroller can switch off the supply voltage to the appliance at the request of transmitter/receiver 32 or at its own initiative, and thereby further reduce the chance of the fire restarting.

In the above described embodiments, which are provided with a microcontroller 7, it is also possible to provide an additional signalling element. FIG. 6 for instance shows that microcontroller 7 is connected to a loudspeaker 34 with which an acoustic signal can be generated. It is however also possible to produce an acoustic signal in other ways or to provide other signalling forms, for instance by connecting microcontroller 7 to a lamp. The control of signalling element 34 can herein be set such that a signal is given before the activation value of the outside temperature is reached in the inner space. If the outside temperature for instance comes within a preset range of for instance 10° C. relative to the activation value, an acoustic and/or optical pre-alarm is then given. Someone present in the vicinity of the appliance can hereby already take measures before the fire actually breaks out.

Although in the embodiment shown in FIG. 6 the communication between extinguishing systems 1, 1' on the one hand and transmitter/receiver 32 on the other, and between transmitter/receiver 32 and the controller takes place in wireless manner, one or all of said communication lines can likewise be embodied using a wire network.

In the shown embodiments the temperature sensor is placed in each case inside housing 2 of extinguishing system 1. The temperature sensor can however also be placed outside the housing, and be in optionally wireless connection with microcontroller 7. Two or more different temperature sensors can also be placed at different positions inside and/or outside the housing so as to make sure that a starting fire is properly detected.

In a determined preferred embodiment, the temperature sensor (also referred to as thermal sensor) is of the differential type, wherein the control activates the fire-extinguishing element when the degree of change in the measured temperature related to the time exceeds a predetermined value for a certain time. This means that the sensor and/or the control is provided with means, for instance a clock or an electronic counter, with which the degree of change per unit of time can be tracked.

As alternative to or in addition to the temperature sensor, the microcontroller can also be connected to a smoke sensor, preferably a CO-sensor or a similar sensor. The smoke sensor detects the presence of smoke gases. More specifically, the smoke sensor is sensitive to combustion and/or pyrolytic products floating in the air. The smoke gases are after all indicative of a starting fire. Since in some cases smoke will develop before sufficient heat develops, this provides the option of either taking earlier action, by for instance giving a pre-alarm, or causing earlier activation of extinguishing element 3, which reduces the chance of damage to the object. Application of both temperature detection and smoke detection furthermore reduces the chance of erroneous extinguishing, which could lead to unnecessary damage and system maintenance. It is also possible to envisage embodiments in which a combined smoke/temperature sensor is applied per extinguishing element 3.

Many types of smoke sensors are available which can be applied in the present situation. An ionization smoke sensor is for instance sensitive to combustion products which are able to influence the ionization current in the sensor. An optical smoke alarm is for instance a sensor which is sensitive to combustion products which can influence the absorption or reflection of light in the infrared, visible and/or ultraviolet range of the electromagnetic spectrum.

Instead of or in addition to the above mentioned sensors, flame sensors can be applied which are sensitive to the radiation emitted by the flames of a fire. A flame sensor can for instance be sensitive to the radiation emitted by the flames of a fire in the infrared spectrum. A flame sensor can also be sensitive to the radiation emitted by the flames of a fire in the ultraviolet spectrum.

In a determined embodiment the control is adapted to keep the temperature sensor switched on and to keep the smoke detector switched off until the inside temperature has reached a preset value. The smoke measurement is therefore not performed continuously, so that the energy consumption of the device can be kept low. Only when the temperature in the inner space increases above a preset threshold detection value (for instance a value between 60 and 70 degrees Celsius), is the smoke detector switched on. Only when the smoke detector also detects a fire through the concentration of smoke gases increasing above a smoke concentration threshold value, is the extinguishing element activated.

An important aspect of the invention is that in all embodiments the temperature inside the housing at which the fire-extinguishing element 3 must come into action, also referred to as the activation value of the outside temperature, is adjustable freely and substantially independently of the composition of the active substances in the fire-extinguishing element 3 itself. In some embodiments the setting of the activation value herein takes place by correct programming of a microcontroller or a similar electronic circuit, while in other embodiments the activation value is set by the correct choice of material for a separating wall in a reaction vessel.

The activation value for setting depends among other things on the nature and size of the inner space for protecting, and in particular the (electrical) components present in the inner space. When for instance the temperature inside a computer housing normally varies between room temperature and 40° C., it is for instance advisable to set the activation value at about 60° C. A temperature of 50° C., at which the pre-alarm is given, can optionally be set here. When the temperature inside a housing of a computer now rises to 50° C., a first optical and/or acoustic alarm is first given. If no action is taken and the cause of the temperature increase is not removed, fire-extinguishing element 3 will then come into operation at 60° C. In other applications, for instance washing machines, switch cabinets, dryers, computers, televisions, monitors, transformers, meter cupboards and so on, the temperature range within which the relevant appliance functions as it should will generally have different values. In most practical applications the activation values vary between 50° C. and 200° C., and preferably between 50° C. and 150° C.

Since the activation value can be set easily in one of the above described ways, the use of standard, universal extinguishing systems is possible.

Figure 7:
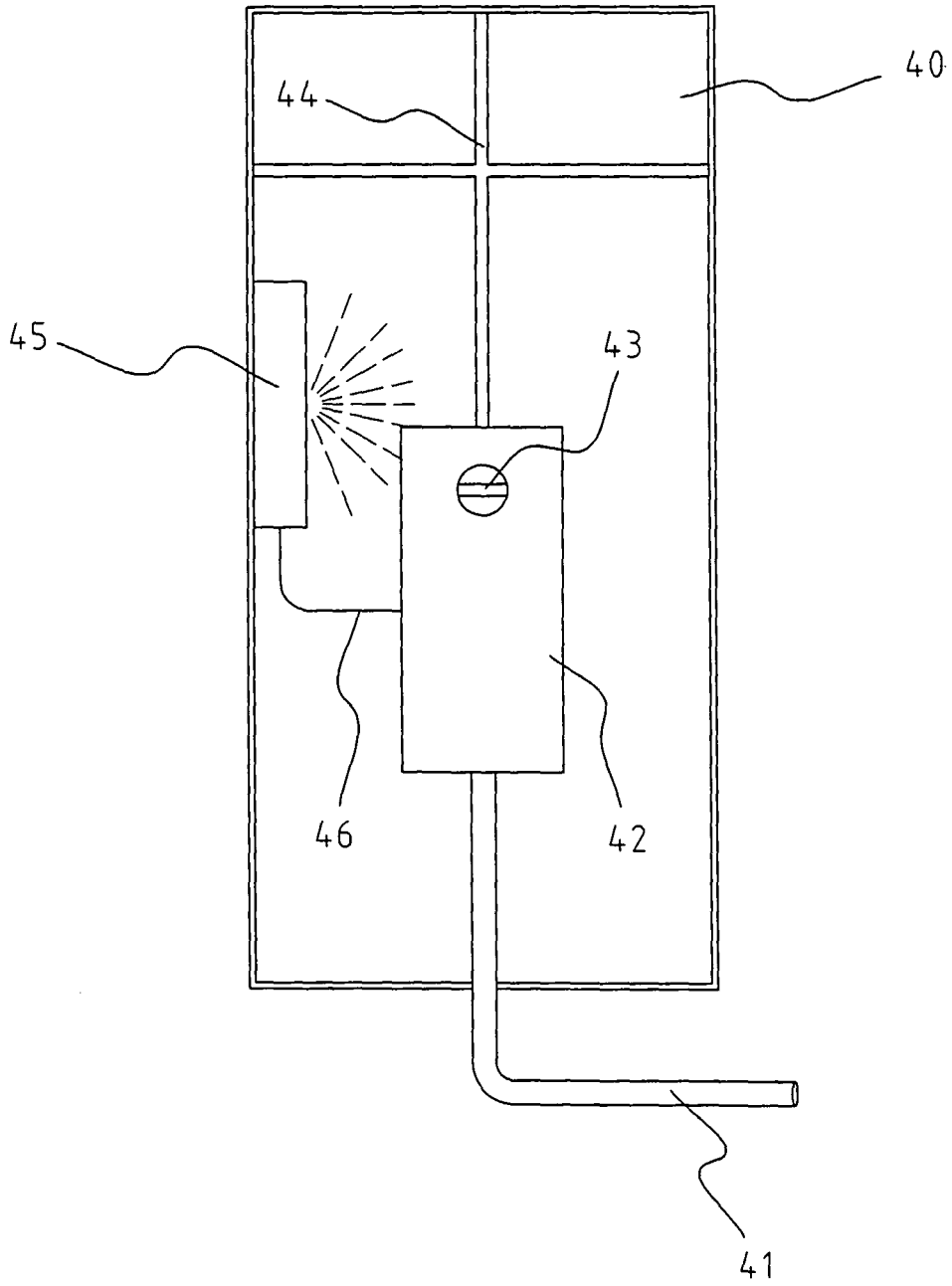
FIG. 7 is a schematic representation of a further preferred embodiment of the present invention.

FIG. 7 shows a schematic representation of a further preferred embodiment of the present invention. Shown is a meter cupboard 40 of a building in which a number of electronic circuits 42 is arranged. Electronic circuits 42 are connected to a power supply line 41 of the domestic electricity mains (usually 220 Volt). On the other side the circuits 42 are connected to electricity cabling 44 in the building. In addition to usually comprising a supply meter, an earth leakage switch and so on, such electronic circuits 42 also comprise a main switch 43 whereby the voltage can be switched off. Fire can occur in such meter cupboards 40, for instance as a result of short-circuiting, which creates a dangerous situation. To enable timely detection and extinguishing of a fire, an extinguishing system 45 according to the invention is arranged in meter cupboard 40. Extinguishing system 45 corresponds with one of the above stated preferred embodiments of the extinguishing system according to the invention.

Extinguishing system 45 is connected to main switch 43 by means of connecting cable 46. The cabling 46 has two functions.

Firstly, it provides the power supply of the extinguishing system 45, so that battery power supply can be omitted or an accumulator provided in extinguishing system 45 can be provided via cable 46, which accumulator remains charged by the supply voltage. The advantage of such a construction is that the fire-extinguishing system 45 thereby has a lifespan which is in principle unlimited, and changing of batteries is unnecessary.

Secondly, cabling 46 makes it possible, when fire is detected and fire-extinguishing system 45 is activated in the above described manner, for the control of the system to switch off the supply voltage to the building, for instance by automatically switching off main switch 43. This has the result that the probable cause of the fire, i.e. the voltage in electronic circuits 42 and/or line 41, is switched off and there is therefore no chance of the fire restarting after the fire has been extinguished. Because the cause of the fire is moreover switched off, no separate indication has to be transmitted, for instance using the above mentioned signalling means and/or the communication means, and these provisions can therefore be omitted.

In another embodiment (not shown) the extinguishing system forms a mechanical component of the main switch, and electrical components are omitted as far as possible or completely. In this embodiment the main switch is under bais, for instance of a metal spring, but is retained by a locking element. The locking element ensures that in normal conditions the main switch remains switched on. If however a fire now breaks out, the fire-extinguishing system is activated in one of the above described ways (preferably via the thermo-cord or via the chemical reaction vessel, since in those embodiments no electricity is required) and the locking element will melt as a result of the heat released during the extinguishing. Under the influence of the bias the main switch is now switched off automatically.

The scope of protection of the invention is not limited to the above described preferred embodiments thereof. The rights sought are rather defined by the content of the following claims, within the scope of which many modifications can be envisaged.

The invention claimed is:

1. A system having a device for protecting an inner space of an object against fire, comprising:

a housing provided with at least one passage opening;

an aerosol-forming extinguishing element which can be arranged in the housing and which includes:

a container for holding extinguishing material which can be activated at a fixed activating temperature;

at least one outlet opening which can be connected to the passage opening in the housing and along which the activated extinguishing material can be carried into the inner space of the object so as to extinguish the fire;

an activating element for bringing at least part of the extinguishing material to the activation temperature;

at least one detection unit for detecting at least one physical and/or chemical parameter representative of fire in the inner space, the at least one detection unit includes a temperature sensor and a smoke detector;

a control unit coupled to the at least one detection unit and the activating element for causing thermal or electrical activation of the extinguishing element by the activating element when a preset activation value of the detected physical and/or chemical parameter is reached, and a power supply, wherein at least that the control unit is connected to the power supply and includes a programmable electronic circuit, in which the activation value of the physical quantity is stored and wherein the at least one detection unit, the control unit and the extinguishing element are all arranged inside the housing so as to provide for an autonomous operation of a self-contained protection device, where, in case of fire, the activating element is connected to the power supply such that extinguishing material is at activation temperature, and wherein the control unit is adapted to keep the temperature sensor switched on and to keep the smoke detector switched off until the inside temperature has reached a preset value, to switch on the smoke detector from the set temperature and to activate the extinguishing element when a concentration of smoke has reached a preset value.

2. The system as claimed in claim 1, wherein the power supply is arranged inside the housing.

3. The system according to claim 1, wherein the housing is embodied for placing in the inner space of the object.

4. The system as claimed in claim 1, wherein the at least one detection unit is a detector for measuring the physical parameter, and the control unit includes an electrical control for controlling the thermal activation of the extinguishing element.

5. The system as claimed in claim 4, wherein the physical parameter is the temperature of the medium in the inner space of the object.

6. The system as claimed in claim 5, wherein the temperature sensor comprises a glass fiber cable.

7. The system as claimed in claim 4, wherein the parameter is a concentration of one or more smoke gases in the inner space.

8. The system as claimed in claim 4, wherein the at least one detector is a flame sensor which is sensitive to radiation emitted by the flames of the fire.

9. The system as claimed in claim 1, wherein the control unit comprises a reaction vessel with at least two reaction spaces separated by a detection unit in the form of a separating element, wherein the separating element is embodied for melting at a preset activation temperature, wherein different chemical substances are arranged in the spaces, which react with each other when the separating element melts in order to activate at least part of the extinguishing material with the released heat of reaction via the thermally conductive element.

10. The system as claimed in claim 1, wherein the activating element comprises:

a thermally conductive body; and a heat source to be controlled by the control unit for heating the thermally conductive body.

11. The system as claimed in claim 10, wherein the heat source comprises an electrical power supply and an electrical resistance.

12. The system as claimed in claim 1, wherein the activating element comprises an electrical ignition to be controlled with the control unit.

13. The system as claimed in claim 1, wherein several extinguishing elements are arranged in the housing.

14. The system as claimed in claim 13, wherein the control of the extinguishing elements is adapted to activate only a first part of the extinguishing elements when a first fire occurs, and to activate a second part of the extinguishing elements when a second fire occurs.

15. The system as claimed in claim 1, further comprising a communication device for transmitting status messages representative of a status of the device.

16. The system as claimed in claim 15, wherein the communication device comprises a transmitter for wireless transmission of messages.

17. The system as claimed in claim 15, wherein the communication device is adapted to receive instruction messages on a basis that the control unit can control the operation of the device.

18. The system as claimed in claim 1, wherein the control unit is coupled to an external power supply for switching on or off thereof.

19. The system as claimed in claim 1, further comprising a signalling device for signalling the activation of the extinguishing element.

20. The system as claimed in claim 19, wherein the signaling device is adapted to generate a pre-alarm as a precursor of activating the extinguishing element.

21. The system as claimed in claim 19, wherein the signalling device is adapted to generate at least one of an acoustic signal and an optical signal.

22. The system as claimed in claim 1, further comprising:

at least one additional device as claimed in claim 1;

transmitters provided in each of the device and the at least one additional device for the purpose of transmitting status messages representative of a status of the device; and a central transmitter/receiver for receiving the status messages from the devices and transmitting the status messages to an external control room or a controller.

23. The system as claimed in claim 1, further comprising a housing of electronic circuits of which an inner space is to be protected against fire, wherein at least the device is arranged inside said inner space so as to fill the inner space with extinguishing material when activated.

24. A method for protecting an inner space of an object against fire, comprising:

placing one or more autonomous and self-contained fire protection devices as claimed in claim 1 inside said inner space to be protected against fire; and setting in each control unit the activation value at which the one or more autonomous fire-extinguishing elements are to be activated.

25. The method as claimed in claim 24, further comprising activating at least one fire-extinguishing element so as to carry extinguishing material into said inner space of the object to extinguish the fire.

26. The method as claimed in claim 24, wherein the object is a housing or casing containing electronic components and the autonomous and self-contained protection device is arranged.

27. The system as claimed in claim 1, wherein the object is a housing or casing containing electronic components and the autonomous and self-contained protection device is arranged inside the housing or casing.

* * * * *